United States Patent [19]

Rayburn

[11] 4,056,891

[45] Nov. 8, 1977

[54] SEQUENTIAL SWITCHING DEVICE

[75] Inventor: Billy R. Rayburn, Rossmore, Calif.

[73] Assignees: Billy R. Rayburn; Paul T. Mu; Alfred F. Hayes, all of Signal Hill, Calif.

[21] Appl. No.: 580,229

[22] Filed: May 23, 1975

[51] Int. Cl.[2] ..... F26B 11/04

[52] U.S. Cl. ..... 34/55; 34/83

[58] Field of Search ..... 34/55, 87, 46, 48; 307/139; 317/154

[56] References Cited

U.S. PATENT DOCUMENTS

| | | | |
|---|---|---|---|
| 3,271,878 | 9/1966 | Martin | 34/48 |
| 3,394,467 | 7/1968 | Janke | 34/48 |
| 3,545,096 | 12/1970 | Salisbury et al. | 34/48 |
| 3,713,226 | 1/1973 | Takeyama | 34/48 |

*Primary Examiner*—John J. Camby
*Assistant Examiner*—Larry I. Schwartz

[57] ABSTRACT

A latching circuit is inserted between the door switch of a dryer or any other unattended device and the operating components thereof. Thus when the door switch is opened the circuit is unlatched and a subsequent closure of the door will not resume operation of the device. To allow for such resumption a push-to-close switch is included across the latching circuit whereby a sequence of closing the door switch followed by manual depression of the push-to-close switch will restart the device.

1 Claim, 2 Drawing Figures

SEQUENTIAL SWITCHING DEVICE

BACKGROUND OF THE INVENTION

1. Field of the Invention

The present invention relates to switching logic and more particularly to override switching adapted for use in coin operated dryers.

2. Description of the Prior Art

Coin operated laundromats are often made available to the public without an attendant present and therefore are subject to abuse. One of the more frequent abusive practices is the intentional or inadvertent exhaustion of the purchased operating time in a device like a gas dryer. A coin operated gas dryer typically includes a timer which can be set for a particular duration and is often enabled by insertion of coins. Very often the customer will find it convenient to terminate the drying cycle before the purchased time has expired. Since this may occur at any time within the period set by the timer, often large amounts of dryer time are left available which if used once the dryer is evacuated, result in a great loss of the gas energy consumed and the consequent loss of revenue to the owners.

Typically, a conventional gas dryer includes a door switch which provides both a safety function and energy conservation function, by interrupting the primary circuit providing power to the dryer. Thus, while a customer may elect to terminate the drying operation before the expiration of the purchased time, removing the articles from the dryer and leaving the door opened, various other persons including children prone to mischief may close the door on the empty dryer causing the dryer to continue operation. Alternatively the customer himself, through inadvertence or force of habit, may elect to close the door after evacuating the dryer, thus resuming the operation of an empty dryer. In each instance, however, a loss in revenue results to the owner of the laundromat and many devices have been developed in the past to avoid this loss.

SUMMARY OF THE INVENTION

Accordingly, it is the general purpose and object of the present invention to provide a latching relay in the door switch circuit which upon the first opening of the door switch can only be re-latched by a subsequent intentional manipulation of yet another switch.

Further objects of the invention are to provide a latching relay in the door switch circuit which is unlatched to interrupt the power to the dryer upon the first opening of the door switch.

Yet other objects of the invention are to provide a latching relay into the circuit of the dryer with minimal disruption of the circuit and with minimal requirements of alignment and maintenance.

Briefly these and other objects are accomplished within the present invention by providing a latching relay with the primary circuit thereof connected in series between the power connection to the dryer and the motor thereof. The latching circuit of the relay, on the other hand, is connected in series with the door switch such that opening of the door will unlatch the relay, removing the power from the dryer motor. To re-latch the relay a push-to-close switch is connected across the latching switch thereof, whereby closure of the door followed by a subsequent depression of the push-to-close switch will re-latch the relay. In this manner, two operations in a predetermined sequence are necessary in order to resume operation of the dryer. Furthermore by selective arrangement of the push-to-close switch it is possible to isolate the operation thereof from persons of small stature, like children.

This additional switching logic between the door switch of the dryer and the operating parts thereof provides for an additional manipulation normally not involved in conventional dryers and therefor a manipulation which is outside the normal habits developed by the user.

DESCRIPTION OF THE SPECIFIC EMBODIMENT

While the following description is made with reference to a dryer such is for the purpose of illustration only. It is to be understood that various other coin operated devices may be similarly provided with switching logic constructed according to the present invention.

Figure 1:
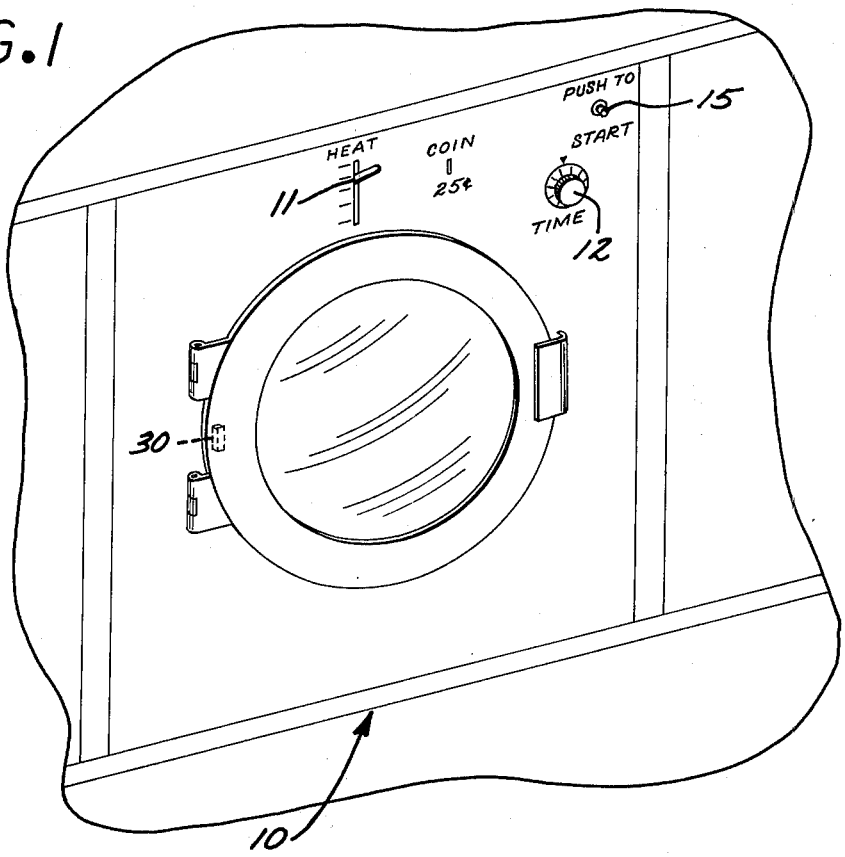
FIG. 1 is a perspective illustration of a typical prior art dryer including a manual switch connected for sequential manipulation according to the present invention.

As shown in FIG. 1 a conventional dryer generally designated by the numeral 10 includes various controls such as a heat selector 11, a timer 12 and a coin chute 13. It is to be noted that in many applications, the use of the dryer is generally offered without charge and in such instances the dryer will be rendered operative without insertion of any coins. Accordingly the typical prior art dryer 10 can be provided both with or without the coin chute 13.

Incorporated with the dryer 10 is an additional control shown by way of a push-to-close palm button 15 which is disposed along with the aforementioned controls but which is arranged in the highest levels of the front of the dryer. Thus children, normally prone to mischief, will have a difficult time reaching the palm button 15 and thus inadvertently resuming the drying cycle.

Figure 2:
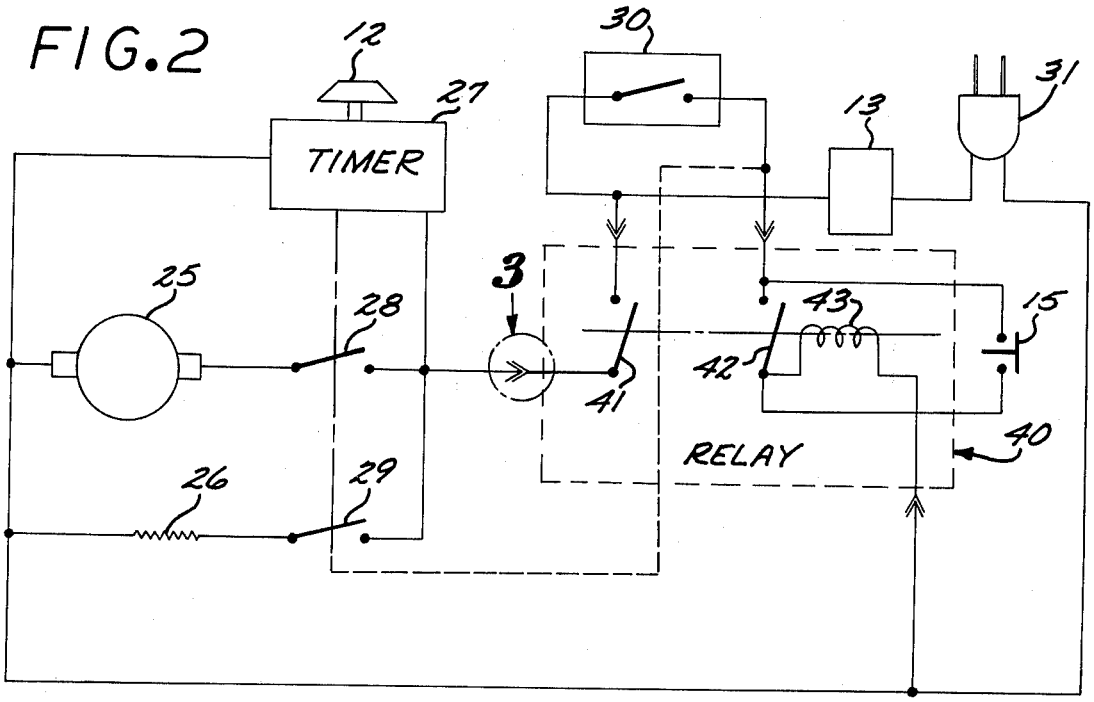
FIG. 2 is a circuit schematic illustrating a conventional prior art dryer mechanism modified according to the present invention.

There are many different dryer configurations in the art. Most typically each includes a motor to drive the tumbler cage thereof and some means to develop heat. Accordingly, as shown in FIG. 2, the dryer 10 is provided with a motor 25 and a load 26 representing either an electrical heating filament or the control winding of a solenoid valve in a gas line. Both the operation of the motor and the load 26 are controlled by a timer 27 which can be selectively set to any desired duration by the timer conrol 12. To illustrate this function timer 27 is shown articulating two line switches 28 and 29 respectively, line switch 28 completing the circuit to the motor 25 and line switch 29 completing the circuit to the load 26.

In the prior art switches 28 and 29 directly connect across a door switch 30 to one side of a power outlet 31. This prior art connection is shown by way of dotted lines in FIG. 2. Thus, the prior art dryer would require only the closure of door switch 30 to resume the drying operation. In addition the more conventional practice is to arrange the coin chute 13, if such is used, in the primary circuit such that the operation thereof is effectively that of a switch in series with the door switch 30.

By way of the present invention the above conventional dryer circuit is modified to include a relay generally designated by the numeral 40 including two ganged switches 41 and 42 and a coil 43. Switch 42 is connected in series between the output of the door switch 30 and one end of coil 43. The other end of coil 43 is connected to the return side of plug 31. Switches 41 and 42 are conventionally spring loaded to a normal open state and are pulled in to a closed state only when the circuit across coil 43 is completed. To provide for such completion, switch 42 includes, in parallel, the push-to-close palm button 15 thereacross. Thus, once a proper selection of coins is deposited in the coin chute 13 the circuit is completed to the door switch 30 and once the door switch is closed the subsequent closure of switch 15 energizes coil 43 to pull in both switches 41 and 42. Once the switch 42 is pulled in a latching circuit is formed which will thus maintain both switches 41 and 42 closed after the release of the palm button 15.

The normally open terminal of switch 41 is connected directly to the output of coin box 13 or, in the instances where there is no coin chute, directly to the high side of plug 31. The arm of switch 41 is connected to excite both the timer 27 and the terminals of switches 28 and 29 when pulled in against this terminal. Accordingly once relay 40 is latched to a closed state and therefore switch 41 is closed, circuit continuity is established between plug 31, motor 25 and load 26. Upon opening of the door and the attendant opening of door switch 30 circuit continuity to switch 42 is interrupted, unlatching the relay and releasing switch 41. Subsequent closure of door switch 30 will not relatch the relay unless and until the palm button 15 is depressed. By way of this circuit a switching sequence is established requiring first that the door switch be closed or that the door of the dryer be closed and secondly a depression of the palm button 15.

While there are many possible ways of implementing the foregoing inventive arrangement, one implementation is shown in FIG. 2. More specifically, as shown in FIG. 2 a conventional four pole, single throw power relay is installed performing the functions of the relay 40 herein. One example of such relay is the relay sold under the Model No. W388ACQX-9 and manufactured by the Magecraft Electronics Co. Two poles of this relay are shown connected across the palm button 15 while the other two poles of the relay are shown tied directly to the plug 31 and to the timer power input. In addition there is shown a ground connection completing the circuit described above across the coil 43.

With this implementation only very minimal modification to the circuit is necessary. Furthermore the relay is provided with conventional spade lugs and therefore the conventional connectors existing in a dryer can be tied directly thereto.

Some of the many advantages of the present invention should now be readily apparent. The invention provides by way of a simple modification an additional switching function which must be taken up in sequence in order to resume the operation of any powered device. Thus the invention provides by way of parts which are reliable, easy to maintain and easy to install.

Obviously many modifications and variations of the foregoing teachings are contemplated within the scope of this invention. It is therefore intended that the scope of the invention be solely determined by the claims appeneded herein.

I claim:

1. In an automated appliance including a door for receiving articles, a source of electrical power, a door switch connected between said source of electrical power and adapted to be articulated to a closed state when said door is closed, and operating means operatively connected to said door switch, the improvement comprising:

a first normally open switch connected in circuit between said door switch and said operating means;

a second normally open switch connected in circuit with said door switch;

coil means connected in circuit with said second normally open switch for pulling in said first and second normally open switch upon receiving electrical excitation from said source of electrical power, said second normally open switch and said coil being disposed in a parallel circuit with said first normally open switch and said operating means; and a third normally open switch formed as a push-to-close palm button adapted for manual articulation and connected in parallel with said second normally open switch for providing a parallel path between said door switch and said coil means.

* * * * *